United States Patent [19]

Gerhart

[11] Patent Number: 4,471,680

[45] Date of Patent: Sep. 18, 1984

[54] CAM SLIDE UNIT

[75] Inventor: Roland T. Gerhart, Milford Township, Oakland County, Mich.

[73] Assignee: IEM Ltd., Novi, Mich.

[21] Appl. No.: 344,705

[22] Filed: Feb. 1, 1982

[51] Int. Cl.[3] ..... B26D 5/16

[52] U.S. Cl. ..... 83/588; 83/627; 83/635; 83/698

[58] Field of Search ..... 83/588, 627, 635, 698; 145/46

[56] References Cited

U.S. PATENT DOCUMENTS

| | | | |
|---|---|---|---|
| 1,910,275 | 5/1933 | Alden | 83/698 X |
| 2,340,162 | 1/1944 | Whistler et al. | 83/588 X |
| 2,539,085 | 1/1951 | Kerseg | 83/627 |
| 3,541,909 | 11/1970 | Franzen | 83/635 X |
| 3,789,895 | 2/1974 | Levinson | 145/46 |

*Primary Examiner*—Donald R. Schran

*Attorney, Agent, or Firm*—Flynn, Thiel, Boutell & Tanis

[57] ABSTRACT

An apparatus for supporting and actuating a punch in a press includes a cam unit body, a cam slide slidably supported on the cam unit body for movement along a first line and having first cam surfaces on opposite sides thereof which are angled with respect to the first line, and a U-shaped driver supported on the cam unit body for movement along a second line, the driver having a second cam surface on each leg thereof which is angled with respect to the second line. The slide is disposed between the legs of the driver and each second cam surface engages a respective first cam surface so that movement of said driver into said cam unit body along said second line moves the slide in one direction along the first line. A slotlike opening oriented parallel to the first line extends transversely through the slide and communicates with an internal cylindrical cavity within the slide, which cavity also extends parallel to the first line. A rod supported on the cam unit body extends through the opening and into the cavity. A coil spring is disposed in the cavity, engages the rod and urges the slide assembly in the opposite direction along the first line. A punch retainer is removably supported on the slide and has an opening therethrough parallel to the first line. The opening in the punch retainer is adapted to receive a punch and the punch is adapted to be held against rotation relative to the punch retainer. A punch backing surface aligned with and facing the opening in the punch retainer is provided on the slide.

12 Claims, 10 Drawing Figures

CAM SLIDE UNIT

FIELD OF THE INVENTION

This invention relates to a device for operationally supporting a metalworking die or tool and, more particularly, to a device for supporting a punch in a press and for effecting movement of the punch in one direction in response to movement of the press in another direction.

BACKGROUND OF THE INVENTION

In the metalworking industry, it is frequently necessary to pierce one or more holes in a metal workpiece. This is typically accomplished by moving one or more punches so that each punch pierces the metal object and produces a hole. In many situations, due to the shape of the article and/or the number and locations of the holes required, it is necessary that the piercing movement of at least one punch occur in a direction other than the direction of travel of the press.

Various cam devices have previously been developed to support a punch and effect movement of the punch in one direction in response to movement of the press in another direction. These devices have generally been acceptable for their intended purposes. Many known devices of this type are designed for heavyduty applications and are therefore large in size and expensive to manufacture.

Accordingly, it is an object of the present invention to provide a cam slide unit which is designed specifically for light-duty applications, is simple in structure, yet rugged and durable and is relatively inexpensive to manufacture.

A further object of the invention is to provide a cam slide unit, as aforesaid, which has a relatively low profile, in order to facilitate its use in a wide variety of applications.

A further object of the invention is to provide a cam slide unit, as aforesaid, in which the retainer that supports the punch is guided through its entire stroke of travel and is secured against rotation and the punch is secured against rotation in the punch retainer.

A further object of the invention is to provide a cam slide unit, as aforesaid, which is rugged, dependable and requires minimal maintenance.

SUMMARY OF THE INVENTION

The objects and purposes of the invention, including those set forth above, are met by providing a cam slide unit for supporting a punch in a press which includes a cam unit body, a cam slide slidably supported on the cam unit body for movement in a first direction between a first position and a second position and having first cam surface means arranged at an angle with respect to the first direction, and a driver supported on the cam unit body for movement along a second direction between third and fourth positions and having a second cam surface thereon which is arranged at an angle with respect to the second direction and operatively engages the first cam surface. A retainer mechanism supports the punch on the slide and a resilient element cooperable with the slide yieldably urges it toward the first position.

According to one feature of the invention, two first cam surfaces are provided on the slide on opposite sides thereof. The driver has two shaped legs and has a second cam surface on each leg. The slide is disposed between the legs of the driver, and each second cam surface engages a respective first cam surface.

According to another feature of the invention, a slotlike opening oriented parallel to the first direction extends transversely through the slide member and communicates with an internal cavity within the slide member. A rod supported on the cam unit body extends through the slotlike opening and into the cavity. The resilient element is disposed in the cavity and is cooperable with the slide and the rod for yieldably urging the slide toward the first position. The cavity is preferably substantially cylindrical and has its axis extending parallel to the first direction. The resilient element is preferably a coil spring having one end disposed against the rod and the other end disposed against one end of the cylindrical cavity. The cylindrical cavity is preferably defined by a cylindrical bore which is provided in the slide and is internally threaded at said one end. A screw stud threadedly engages the internal threads of the bore and closes said one end of the cylindrical cavity.

According to a further feature of the invention, the retainer mechanism includes a punch retainer which has an opening therethrough substantially parallel to the first direction and is removably supported on the slide. A punch backing surface is provided on the slide which faces substantially in the first direction and is aligned with the opening in the punch retainer. Preferably, the slide has a substantially cylindrical recess therein, the punch retainer has thereon a substantially cylindrical projection which has a diameter substantially equal to and is slidably disposed in the recess in the slide, the opening in the punch retainer extends through the projection, and a disk-shaped punch backing plate having a diameter substantially equal to that of the recess is disposed therein, the punch backing surface being provided on the punch backing plate. The punch retainer preferably has a planar surface on one side thereof extending substantially parallel to the first direction, and the cam unit body has a second planar surface slidably engaging the first planar surface, thereby preventing rotation of the punch retainer and the slide about an axis parallel to the first direction. Further, the punch retainer and/or the cam slide has means for preventing rotation of the punch relative to the punch retainer.

BRIEF DESCRIPTION OF THE DRAWINGS

A more complete understanding of the objects, purposes and advantages of this invention by persons familiar with apparatus of this general type will result from reading the following detailed description and inspecting the accompanying drawings, in which.

Figure 1:
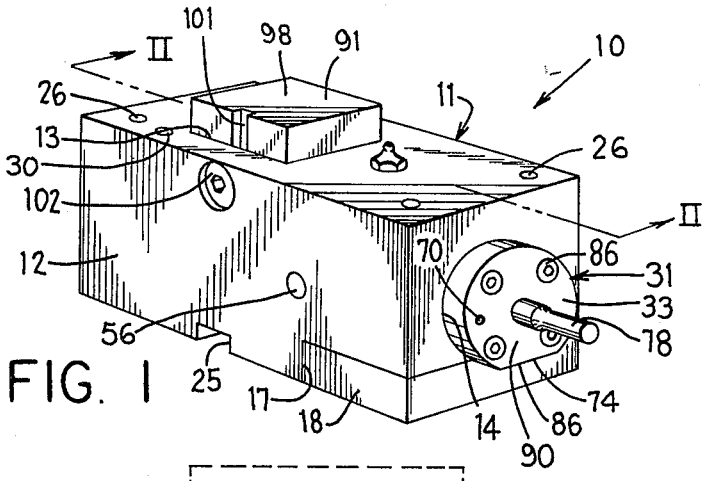
FIG. 1 is a perspective view of a cam slide unit according to the present invention.

Certain terminology will be used in the following description for convenience in reference only and will not be limiting. The words "up", "down", "right" and "left" will designate directions in the drawings to which reference is made. The words "in" and "out" will respectively refer to directions toward and away from the geometric center of the device and designated parts thereof. Such terminology will include the words specifically mentioned, derivatives thereof and words of similar import.

DETAILED DESCRIPTION

Figure 2:
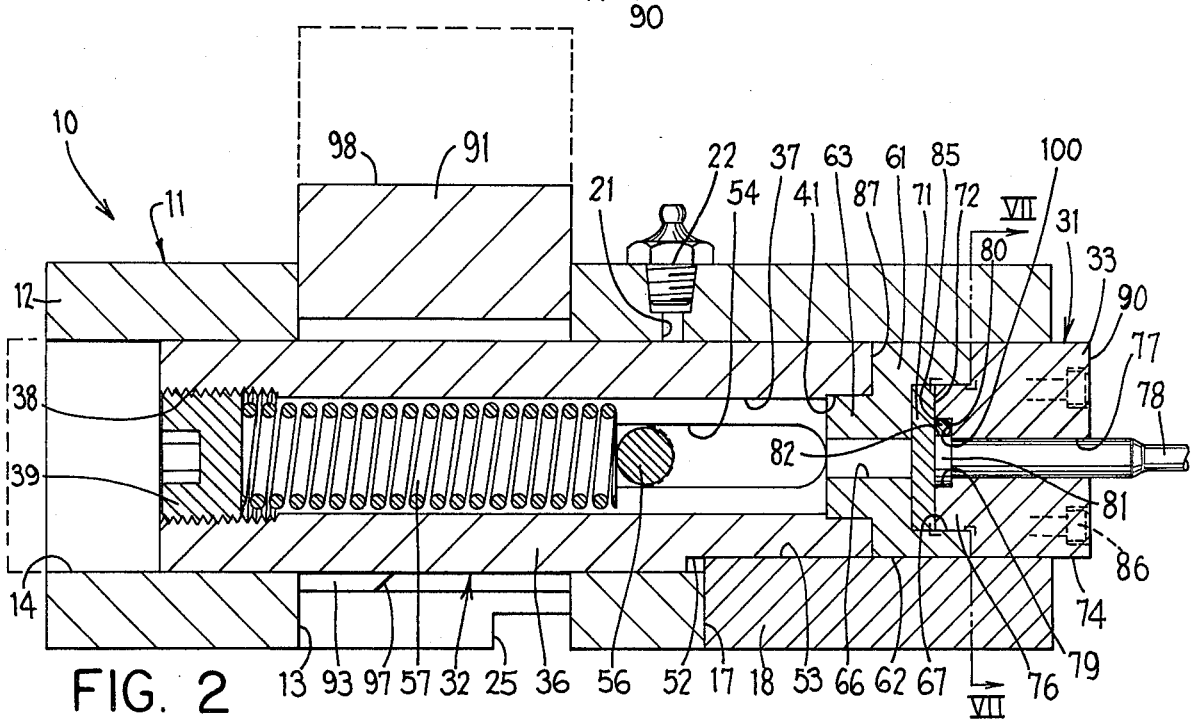
FIG. 2 is a sectional view taken along the line II—II of FIG. 1.
Figure 6:
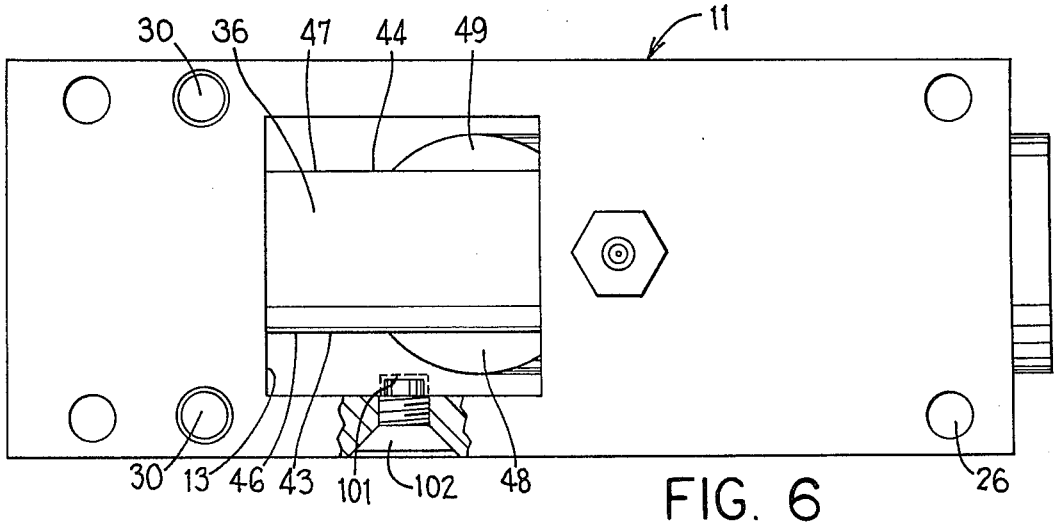
FIG. 6 is a top plan view of the cam slide unit with the driver omitted.

Referring to FIGS. 1 and 2, a cam slide unit 10 has a frame or housing 11 which includes a substantially rectangular body block 12. A vertical opening 13 of square cross section is provided through the body 12. A horizontal cylindrical opening 14 is provided through the body 12. The horizontal opening 14 communicates with the vertical opening 13 within the body 12. The axis of the horizontal opening 14 preferably is parallel to two opposite lateral sides of the square opening 13 and preferably intersects the centerline of the square opening 13. The length of the sides of the square opening 13 is slightly greater than the diameter of the opening 14.

A rectangular recess 17 is provided in the underside of the body 12 at one end thereof and intersects the lower portion of the cross section of the horizontal opening 14 at that end (see FIGS. 1 and 2). A guide plate 18 having a size identical to that of the recess 17 is fixedly secured to the body 12 in the recess 17 in any conventional manner, for example by conventional and not-illustrated screws. The guide plate 18 thus projects slightly into the lower side of the cylindrical opening 14 at one end thereof.

A vertical opening 21 is provided in the top of the body 12 and communicates with the horizontal opening 14. A conventional lubrication fitting 22 is threadedly received in the upper end of the opening 21. During periodic maintenance of the cam unit 10, a lubricant can be supplied to the interior of the horizontal opening 14 through the fitting 22 and opening 21.

A rectangular recess 25 is provided in the underside of the body 12 and extends in a direction substantially perpendicular to the axis of the cylindrical opening 14. A vertical opening 26 is provided near each corner of the frame or housing 11 and extends completely therethrough. Two vertical openings 30 are provided through the body 12 for receiving locating dowels to fix the cam unit in position on a die shoe.

A substantially cylindrical punch support assembly 31 (FIG. 2) has an outside diameter substantially equal to the inside diameter of the horizontal opening 14 and is horizontally slidably disposed therein. The punch support assembly 31 comprises a punch retainer 33, a retainer mounting member 61 and a slide assembly 32.

Referring to FIG. 2, the slide assembly 32 includes a substantially cylindrical slide 36 having a coaxial cylindrical bore 37 extending therethrough. The cylindrical bore 37 has internal threads 38 at one end thereof. A screw stud 39 threadedly engages the internal threads 38 and closes the leftward end of the bore 37. The other end 41 of the cylindrical bore 37 is counterbored to have a diameter slightly greater than the rest of the bore 37.

Figure 3:
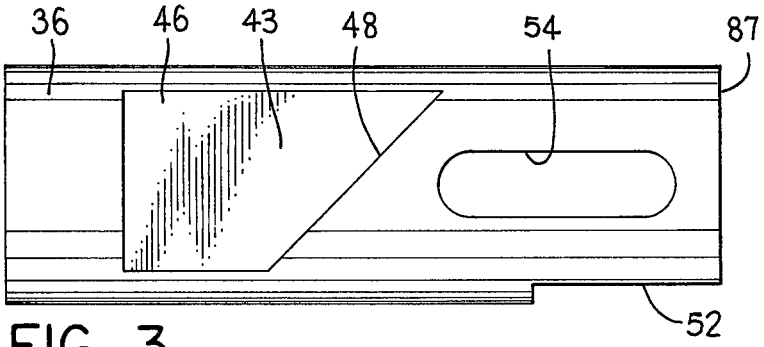
FIG. 3 is a side view of the slide which is a component of the device of FIG. 1.
Figure 4:
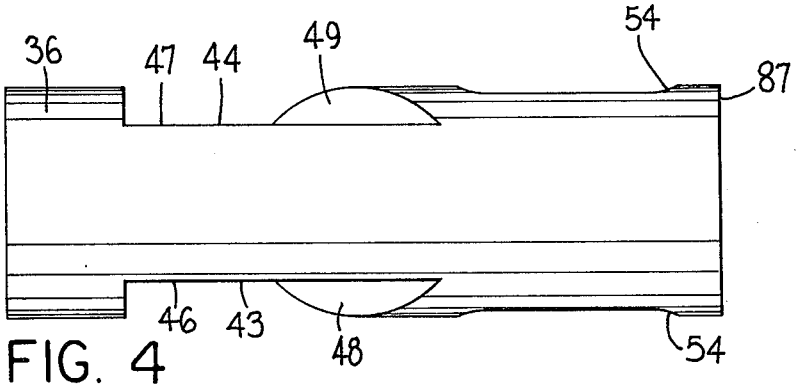
FIG. 4 is a top view of the slide of FIG. 3.

Referring to FIGS. 3 and 4, the slide member 36 has recesses 43 and 44 on opposite sides thereof. The recesses have respective planar bottom surfaces 46 and 47 which are of trapezoidal shape. Respective planar cam surfaces 48 and 49 are defined by the corresponding rightward sides of the recesses, the shape of each cam surface 48 and 49, in plan view, being substantially that of a sector of a circle. In the illustrated embodiment, the cam surfaces 48 and 49 lie in a plane which forms an angle of substantially 45° with respect to a horizontal plane containing the axis of the slide member 36. It will be understood, however, that the angle of inclination of cam surfaces 48 and 49 is not limited to an angle of 45°, but rather, it can be any suitable angle for effecting horizontal movement of the slide assembly 32 in response to vertical movement of the driver 91, as hereinafter described.

A substantially planar surface 52 is provided on the underside of the slide member 36 at the rightward end thereof and, as illustrated in FIG. 2, is slidably disposed against the planar top surface 53 of the guide plate 18, thereby preventing rotation of the slide member 36 about its central axis.

A slotlike opening 54 is oriented parallel to the lengthwise axis of and extends transversely through the slide member 36. A stationary dowel or rod 56 extends through the opening 54 in the slide member 36 and has its ends fixedly supported, such as by press fitting, in the body 12 on opposite sides of the horizontal cylindrical opening 14. The rod 56 and slot 54 are preferably positioned so that the centerline of the rod 56 intersects the common axis of the slide member 36 and cylindrical opening 14. A helical compression spring 57 is provided in the cavity defined by the cylindrical bore 37 and screw stud 39, and has one end disposed against the rod 56 and its other end disposed against the inner end of the screw stud 39. The spring 57 continuously urges the punch support assembly 31 leftwardly in FIGS. 1 and 2 with respect to the housing 11.

The slide assembly 32 also includes a substantially cylindrical retainer mounting member 61 having an external, horizontally extending, planar surface 62 on one side thereof which is slidably disposed against the top surface 53 of the guide plate 18, so that the retainer mounting member 61 can slide horizontally, but cannot rotate about its central axis, relative to the frame 11. The retainer mounting member 61 has a coaxial cylindrical boss 63, which has a diameter substantially equal to and is snugly received in the end portion 41 of the cylindrical bore 37 in the slide member 36. A coaxial cylindrical opening 66 having a diameter less than that of the projection 63 is provided through the retainer mounting member 61. A coaxial cylindrical recess 67 having a diameter slightly greater than that of the bore 37 in the slide member 36 is provided in the end of the retainer mounting member 61 opposite the projection 63.

The punch retainer 33 and the retaining mounting member 61 have mating axially extending and axially aligned openings near their peripheries for receiving a dowel 70 so that these parts can be held in proper orientation relative to each other.

A punch backing plate 71 is disposed in and has a diameter substantially equal to that of the recess 67 in the retainer mounting member 61. The punch backing plate 71 has a substantially planar punch backing surface 72 thereon which faces and contacts the punch retainer 33.

Figure 7:
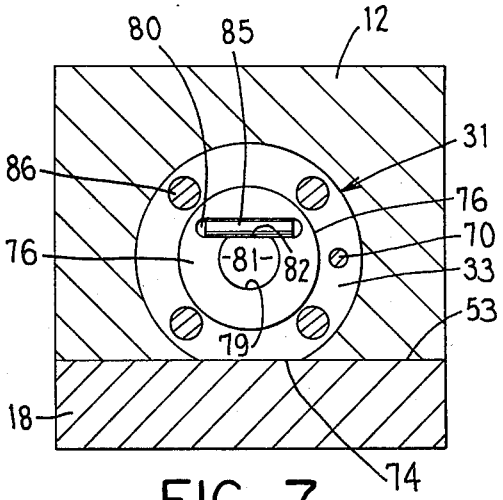
FIG. 7 is a sectional view taken along the line VII—VII in FIG. 2.

Referring to FIG. 2, the punch retainer 33 has a planar surface 74 thereon which slidably engages the planar top surface 53 of the guide plate 18, thereby preventing rotation of the punch retainer 33 about its axis. A coaxial cylindrical projection 76 provided on the punch retainer 33 is slidably received in and has a diameter substantially equal to that of the recess 67 in the retainer mounting member 61. The coaxial cylindrical projection 76 has a coaxial counterbore 79. A coaxial cylindrical opening 77 provided through the punch retainer 33 has a diameter substantially equal to that of the shank of a selected conventional head-type punch 78 which is operationally supported by the cam unit 10. The punch 78 extends through the opening 77. The head 81 of the punch 78 is disposed within the counterbore 79 and adjacent to the punch backing surface 72 on the punch backing plate 71. The depth of the counterbore 79 is substantially the same as the height of the punch head 81 so that the punch head is clamped between the backing plate 71 and surface 100. The diameter of the counterbore 79 is very slightly larger than the diameter of the punch head 81 and the counterbore 79 is coaxial with the cylindrical opening 77. As shown in FIG. 7, the counterbore 79 is machined to provide a lateral groove 80 which extends substantially tangentially to the shank of the punch 78. The head 81 of the punch 78 has a flat 82 located in the groove 80. A pin 85 is disposed in the groove 80 and engages the flat 82 whereby the punch 78 is held against rotation relative to the punch retainer 33. A plurality of bolts 86 extend through aligned openings provided in the punch retainer 33 and retainer mounting member 61 at angularly spaced locations along the peripheries thereof and threadedly engage respective threaded openings provided in the axially facing end surface 87 of the slide member 36. The heads of the bolts 86 are disposed in counterbores in the rightward axial end of the punch retainer 33 so as to be substantially flush with surface 90 of the punch retainer 33.

Figure 5:
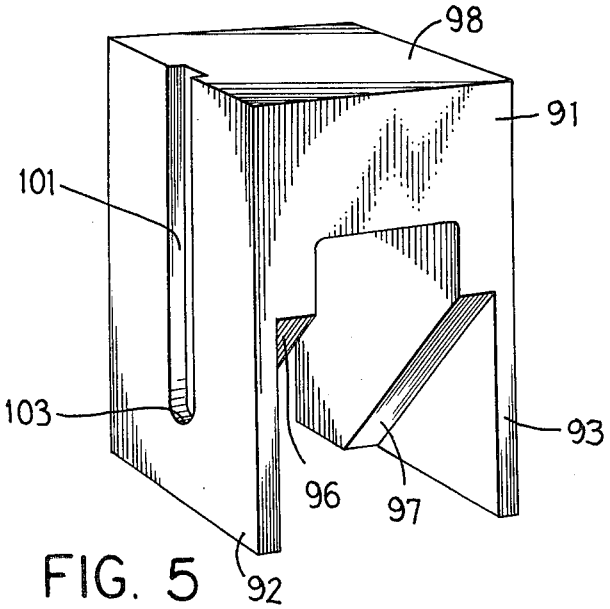
FIG. 5 is a perspective view of the driver which is a component of the device of FIG. 1.

Referring to FIGS. 1 and 5, the cam unit 10 also includes a U-shaped driver 91 having a pair of spaced legs 92 and 93. The driver 91 has a square cross section substantially equal in size to the cross section of the vertical opening 13 through the body 12 and is slidably received in the vertical opening 13, its legs 92 and 93 being disposed on opposite sides of the slide member 36 and partially within the recesses 43 and 44 thereon. Each of the legs 92 and 93 of the driver 91 has a respective cam surface 96 and 97 thereon, the cam surfaces 96 and 97 being substantially parallel to and slidably engaging the respective cam surfaces 48 and 49 on the slide member 36. The driver 91 extends sufficiently above the top surface of the housing 11 so that its top surface 98 is positioned above the top of the fitting 22 in all positions of operation.

A vertical groove 101 is provided in the driver 91 on the outer surface of the leg 92 thereof. The groove 101 extends downwardly from the top surface 98 approximately ¾ of the height of the driver 91. A driver retaining socket head screw 102 (FIG. 1) is threadedly engaged in a horizontal opening in the housing 11, and the tip of the screw 102 extends slightly into the groove 101. Engagement of the screw 102 with the lower end 103 of the groove 101 prevents inadvertent removal of the driver 91 from the housing 11 of the cam slide unit 10.

MODIFICATIONS

Figure 8:
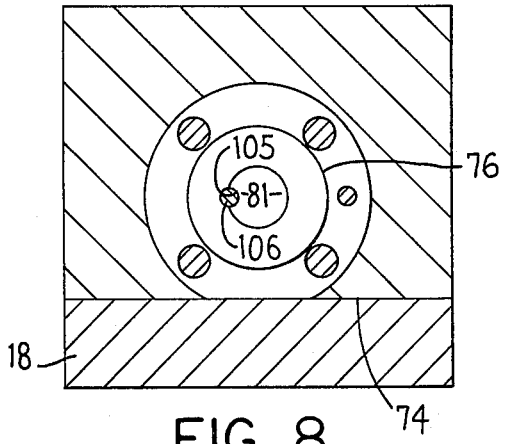
FIG. 8 is a view similar to FIG. 7 and showing a first alternate embodiment of means to prevent rotation of the punch relative to the punch retainer.
Figure 9:
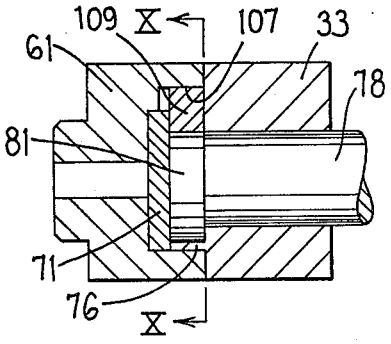
FIG. 9 is a sectional view corresponding to a fragment of FIG. 2 and showing a second alternate embodiment of means to prevent rotation of the punch relative to the punch retainer.
Figure 10:
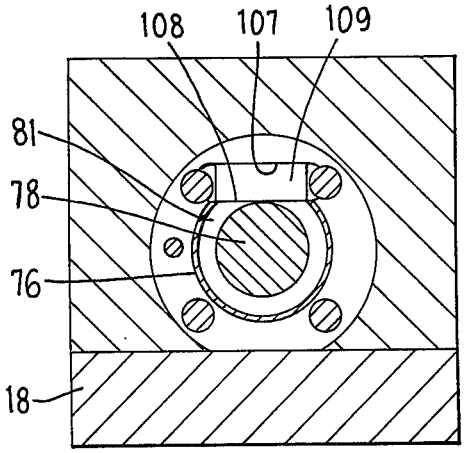
FIG. 10 is a sectional view taken along the line X—X of FIG. 9.

The punch 78 can be held against rotation with respect to the punch retainer 33 in a variety of different ways. Thus, in FIG. 8, an axially extending recess 105 is drilled through a peripheral portion of the punch head 81 and the adjacent inner peripheral portion of the projection 76. A dowel 106 is disposed in the recess 105 to lock the punch 78 against rotation. The outer end of the dowel 106 is flush with the surface of the punch head 81. In FIGS. 9 and 10, a portion of the recess 67 and the adjacent portion of the projection 76 are machined to form a groove 107 which extends tangentially to the shank of the punch 78. The head of the punch 81 has a flat 108 forming a side of the groove 107. A pin 109 is disposed in the groove 107 and engages the flat 108 whereby to hold the punch 78 against rotation.

OPERATION

Although persons skilled in the art will understand the operation of the cam slide unit 10 from the foregoing description, a summary of such operation is now given for convenience.

First, the cam slide unit 10 is mounted in a conventional and not-illustrated press which has a die set comprised of a pair of shoes supported for movement toward and away from each other. For convenience, it will be assumed that the relative movement of the shoes is in a vertical direction. One of the shoes, preferably the lower shoe, is provided with four threaded holes having a relative spacing identical to that of the holes 26 in the cam unit 10, and the cam unit 10 is securely mounted on the lower shoe by not-illustrated bolts which each extend downwardly through a respective opening 26 and threadedly engage a respective one of the threaded openings in the shoe. In addition, an elongated bar of rectangular cross section is preferably provided on the shoe and received within the recess 25 of the cam unit 10 in order to minimize movement of the cam unit 10 relative to the lower shoe. Dowel pins are press fitted into hole 30 and the lower die shoe to fix the cam unit in position.

The bolts 86 are then loosened and removed and the punch retainer 33 is removed from the cam unit 10. As previously described, the projection 76 is counterbored by the toolmaker to the appropriate diameter and depth to receive the punch head 81 of punch 78 thus establishing surface 100. A conventional punch 78 is inserted through the opening 77 with its head 81 disposed against the surface 100 of the punch retainer 33. The pin 85 is then placed in the groove 80. The punch retainer 33 is then replaced in the cam unit 10 and the bolts 86 are replaced and tightened until the head 81 of the punch 78 is securely clamped between the surface 100 of the punch retainer 33 and the punch backing surface 72 on the punch backing plate 71.

The spring 57 will have moved the punch support assembly 31 leftwardly in FIG. 2 until the rod 56 is adjacent the righthand end of the slot 54 in the slide member 36. As the punch support assembly 31 moved to this position, the cam surfaces 48 and 49 acted on the cam surfaces 96 and 97 of the driver 91 and urged the driver 91 upwardly within the vertical opening 13 in the housing 11. At this time, the driver 91 and slide 32 are in the positions schematically shown in broken lines in FIG. 2.

The object in which a hole is to be punched is then fixedly supported in an appropriate manner at a location just beyond the tip of the punch 78. The press is actuated and, as the shoes come together, the upper shoe engages the top surface 98 of the driver 91 and urges the driver 91 downwardly, causing the cam surfaces 96 and 97 thereon to cooperate with the cam surfaces 48 and 49 on the punch support assembly 31 and urge the punch support assembly 31 rightwardly to the position illustrated in solid lines in FIG. 2, thereby effecting rightward movement of the punch 78 into operative engagement with the object to be punched. When the shoes of the press thereafter separate, the spring 57 will urge the punch support assembly 31 leftwardly and the driver 91 upwardly to their original positions, as described above. The operational cycle of the press just described would then be repeated.

It is possible to use the cam unit 10 with a variety of conventional headed punches 78 of differing diameter by altering punch retainer 33, i.e., boring and counterboring, to accommodate different punch sizes. These punch retainers 33 are substantially identical, except that the axial length can be varied to accommodate different punch lengths.

Although FIGS. 2, 7, 8, 9 and 10 show various structures for preventing rotation of the punch 78 relative to the punch retainer 33, such a structure is required only when the hole to be formed in the workpiece is not round. When the hole to be formed in the workpiece is round, the circular punch used for that purpose need not be keyed to the punch retainer 33, but rather, it can be mounted so that it can move arcuately in said punch retainer about its longitudinal axis, for example, by using a round punch head 81 and eliminating the lateral groove 80 and the pin 85 (FIGS. 2 and 7).

Although a particular preferred embodiment of the invention has been disclosed in detail for illustrative purposes, it will be recognized that variations or modifications of the disclosed device, including the rearrangement of parts, lie within the scope of the present invention.

The embodiments of the invention in which an exclusive property or privilege is claimed are defined as follows:

1. A cam slide unit for supporting a punch in a press, comprising:

a cam unit body;

an elongated punch support assembly supported on said cam unit body for movement in a first direction between a first position and a second position, said punch support assembly having a first cam surface arranged at an angle with respect to said first direction and having means for supporting a punch, said punch support assembly also having an internal, lengthwise extending cavity therein and having an elongated opening which extends in a second direction substantially normal to said first direction, is elongated in said first direction, and communicates with said cavity;

a rod supported on said cam unit body and extending in said second direction through said elongated opening and into said cavity;

resilient means disposed in said cavity and cooperable with said punch suppport assembly and said rod for yieldably urging said punch support assembly toward said first position; and a driver supported on said cam unit body for movement in a third direction between a third position and a fourth position, said driver having a second cam surface thereon arranged at an angle to said third direction and engaging said first cam surface on said punch support assembly, whereby said movement of said driver from said third to said fourth position effects movement of said punch support assembly from said first to said second position against the urging of said resilient means.

2. The cam slide unit of claim 1, wherein said cavity in said punch support assembly is substantially cylindrical, the axis thereof extending substantially in said first direction, and wherein said resilient means is a compression coil spring having one end disposed against said rod and the other end disposed against one end of said cavity.

3. The cam slide unit of claim 2, wherein said cavity is defined by a substantially cylindrical bore provided coaxially in said punch support assembly and which is internally threaded at said one end thereof, and including a screw stud threadedly engaging said internal threads of said bore, said screw stud closing said one end of said cavity, said other end of said coil spring abutting against said screw stud.

4. A cam slide unit for supporting a punch in a press, comprising:

an elongated cam unit body having a forward end and a rearward end, said cam unit body having a longitudinally extending opening penetrating through the forward end of said cam unit body and having an upwardly directed opening intersecting said longitudinally extending opening;

a reciprocable punch support assembly slidably disposed in said longitudinally extending opening for movement lengthwise therein between a retracted position and a projecting position, a driver slidably disposed in said upwardly directed opening in said cam unit body for vertical movement between an upper and lower position, said driver having means engaging said punch support assembly so that movement of said driver from said upper to said lower position moves said punch support assembly in a first direction from said retracted position to said projecting position;

said punch support assembly having a forwardly opening cylindrical recess on the axial end thereof adjacent the forward end of said cam unit body; a punch retainer extending forwardly from the forward end of said punch support assembly, said punch support assembly having a laterally enlarged forward portion abutting against the forward axial end of said punch support assembly, said punch retainer having a rearward portion of reduced size defining a cylindrical projection closely slidably received in said cylindrical recess, the forward portion of said punch retainer having an external wall closely slidably engaging the wall of said longitudinally extending opening in all positions of said punch support assembly in said longitudinally extending opening in said cam unit body, said punch retainer having a punch-receiving passageway extending from the rear end thereof through the front end thereof, said passageway having an enlarged counterbore at the rear end thereof and disposed within said recess; a punch mounted on and extending through said passageway in said punch retainer and projecting forwardly therefrom, said punch having an enlarged head at the inner end thereof which head is received in said counterbore and abuts against a punch backing surface at the bottom of said cylindrical recess, a pin engaging said enlarged head of said punch and said counterbore for preventing rotation of said punch with respect to said punch retainer, said punch retainer being at least partially received in said longitudinally extending opening in said cam unit body when said punch support assembly is in said projecting position whereby said punch retainer and thereby said punch is guided throughout the entire stroke of its travel; and means releasably affixing said punch retainer and said punch to said punch support assembly.

5. The cam slide unit of claim 4, wherein said punch support assembly includes a disk-shaped punch backing plate disposed in said recess and having an outside diameter substantially equal to said inside diameter of said recess, said punch backing surface being provided on said punch backing plate.

6. The cam slide unit of claim 5, wherein:

said punch support assembly includes a substantially cylindrical slide member having plural threaded openings in one axial end thereof and includes a retainer mounting member releasably coupled to said slide member, said recess being provided in said retainer mounting member; and a plurality of bolts, each said bolt extending through aligned openings in said punch retainer and said retainer mounting member and threadedly engaging a respective said threaded opening in said slide member whereby to releasably secure said punch retainer and said retainer mounting member to said slide member.

7. The cam slide unit of claim 4, including means for preventing rotation of said punch retainer about an axis substantially parallel to said first direction, said rotation-preventing means including a first planar surface on said punch retainer which is substantially parallel to said first direction, a second planar surface fixedly mounted on said cam unit body and which is substantially parallel to and engages said first planar surface to prevent rotation of said punch retainer with respect to said cam unit body.

8. A cam slide unit for supporting a punch in a press, comprising:

a cam unit body having a vertical opening of square cross-section and having a horizontal cylindrical opening of uniform diameter penetrating through the forward and rearward sides of said cam unit body, said horizontal opening intersecting said vertical opening so that the axis of said horizontal opening is parallel to two opposite lateral sides of said square vertical opening and intersects the vertical centerline of said square vertical opening; a reciprocable cylindrical punch support assembly slidably disposed in said horizontal opening for movement lengthwise in said horizontal opening between a retracted position and a projecting position in which it projects from the forward side of said cam unit body, said punch support assembly comprising a substantially cylindrical slide having a coaxial central bore extending therethrough, a retainer mounting member disposed in the forward end of said bore and a punch retainer received in said retainer mounting member, said slide having an internal screw thread at the rearward end of said bore and having an axially elongated slot extending transversely from said bore through the wall of said slide, said slot being located near to the forward end of said bore and forwardly of said vertical opening; a stationary rod affixed to said cam unit body and extending through said slot whereby to limit movement of said slide in the forward and rearward directions; a plug screw-threaded in said rearward end of said bore and closing said rearward end of said bore; a compression coil spring disposed in said bore and bearing at its opposite ends against said rod and said plug for continuously urging said punch support assembly to said retracted position; said slide having a pair of recesses on diametrically opposite sides thereof and facing said two opposite lateral sides of said square vertical opening, said recesses each having an upwardly and forwardly inclined planar cam surface having the shape of a sector of a circle, said slide having portions of circular cross-section on opposite axial sides of said recess and also adjacent the forward end of said slide, said portions slidably engaging the wall of said horizontal opening in said cam unit body so that said slide is confined to slide axially in said horizontal opening; a driver of square cross-section slidably disposed in said vertical opening in said cam unit body for vertical movement between an upper and a lower position, said driver having a pair of downwardly extending legs extending into said recesses, said legs each having a cam surface slidably engaging a cam surface on said slide so that movement of said driver from said upper to said lower position moves said punch support assembly from said retracted position to said projecting position;

said retainer mounting member having a coaxial cylindrical boss on the rearward axial side thereof which boss projects into said forward end of said bore in said slide, said retainer mounting member having a coaxial cylindrical recess on the forward axial side thereof; a punch backing plate disposed in and partially filling said recess; said punch retainer having a coaxial cylindrical projection received in said cylindrical recess, said punch retainer having a cylindrical external wall closely slidably engaging the wall of said horizontal opening in all positions of said punch support assembly in said horizontal opening; a punch mounted on said punch retainer and projecting axially forwardly therefrom, said punch having an enlarged head at the axially rearward end thereof which head abuts against said punch backing plate, the length of said punch support assembly being such that said punch retainer is at least partially received in said horizontal opening in said cam unit body when said punch support assembly is in said projecting position whereby said punch retainer is guided throughout the entire stroke of its travel with respect to said cam unit body.

9. A cam slide unit for supporting a punch is a press, comprising:

a cam unit body having a vertical opening and having a horizontal cylindrical opening of uniform diameter penetrating through the forward and rearward sides of said cam unit body, said horizontal opening intersecting said vertical opening so that the axis of said horizontal opening is perpendicular to and intersects the vertical centerline of said vertical opening, said cam unit body having a rectangular recess formed in the lower side thereof adjacent to the forward side thereof, said rectangular recess intersecting the lower portion of said horizontal opening at the forward end thereof; a reciprocable cylindrical punch support assembly slidably disposed in said horizontal opening for movement lengthwise in said horizontal opening between a retracted position and a projecting position in which projects from the forward side of said cam unit body, said punch support assembly comprising a substantially cylindrical slide having a coaxial central bore extending therethrough, a retainer mounting member at the forward end of said bore; a punch retainer received in said retainer mounting member, said punch retainer having a cylindrical external wall closely slidably engaging the wall of said horizontal opening in all positions of said punch support assembly in said horizontal opening; resilient means disposed in said bore for continuously urging said punch support assembly to said retracted position; said slide having first cam surface means thereon; a driver slidably disposed in said vertical opening in said cam unit body for vertical movement between an upper and a lower position, said driver having second cam surface means slidably engaging said first cam surface means on said slide so that movement of said driver from said upper to said lower position moves said punch support assembly from said retracted position to said projecting position; said retainer mounting member having a coaxial cylindrical recess on the forward axial side thereof; a punch backing plate disposed in and partially filling said recess; said punch retainer having a coaxial cylindrical projection received in said cylindrical recess; the forward end of said slide, said retainer mounting member and said punch backing plate having axially aligned planar surfaces flush with the upper surface of said rectangular recess in said cam unit body, and a rectangular guide plate secured in said rectangular recess and engaging said aligned planar surfaces, whereby to prevent rotation of said slide, said retainer mounting member and said punch retainer; a punch mounted on said punch retainer and projecting axially forwardly therefrom, said punch having an enlarged head at the axially rearward end thereof which head abuts against said punch backing plate, the length of said punch support assembly being such that said punch retainer is at least partially received in said horizontal opening in said cam unit body when said punch support assembly is in said projecting position whereby said punch retainer is guided throughout the entire stroke of its travel with respect to said cam unit body.

10. A cam slide unit as claimed in claim 9 including a flat formed in the head of said punch and a pin engaging said flat and received in a lateral groove in said punch retainer so that the punch is held against rotation relative to said punch retainer.

11. A cam slide unit as claimed in claim 9 including a flat formed in the head of said punch and a pin engaging said flat and received ina lateral groove in said retainer mounting member so that the punch is held against rotation relative to said punch retainer.

12. A cam slide unit as claimed in claim 8 wherein said driver has a vertical groove in one of the lateral side walls thereof, said groove being closed at the lower end thereof; and a driver-retaining screw threaded into said cam unit body and having a tip extending into said groove so that said driver is releasably retained in said cam unit body.

* * * * *

UNITED STATES PATENT AND TRADEMARK OFFICE

CERTIFICATE OF CORRECTION

PATENT NO. : 4 471 680

DATED : September 18, 1984

INVENTOR(S) : Roland T. Gerhart

It is certified that error appears in the above—identified patent and that said Letters Patent is hereby corrected as shown below:

Column 8, line 47; change "support assembly" to ---retainer---.

Column 10, line 57; change "is" to ---in---.

Column 11, line 7; after "which" insert ---it---.

Column 12, line 26; change "ina" to ---in a---.

Signed and Sealed this

Fifth Day of March 1985

[SEAL]

*Attest:*

DONALD J. QUIGG

*Attesting Officer* *Acting Commissioner of Patents and Trademarks*